US009392838B2

(12) United States Patent
Fischer et al.

(10) Patent No.: US 9,392,838 B2
(45) Date of Patent: Jul. 19, 2016

(54) PROTECTIVE COVER FOR AN ARTICLE OF FOOTWEAR

(71) Applicant: Fi-Ber Sports, Inc., Eagle, ID (US)

(72) Inventors: Thomas Fischer, Meridian, ID (US); Michael Seibert, Eagle, ID (US); Cullen W. Hays, McMinnville, OR (US)

(73) Assignee: Fi-Ber Sports, Inc., Eagle, ID (US)

( * ) Notice: Subject to any disclaimer, the term of this patent is extended or adjusted under 35 U.S.C. 154(b) by 0 days.

(21) Appl. No.: 14/494,100

(22) Filed: Sep. 23, 2014

(65) Prior Publication Data

US 2016/0081421 A1 Mar. 24, 2016

(51) Int. Cl.
*A43B 5/16* (2006.01)

(52) U.S. Cl.
CPC ..... *A43B 5/1608* (2013.01); *A43B 5/16* (2013.01); *A43B 5/1666* (2013.01)

(58) Field of Classification Search
CPC .... A43B 5/1608; A43B 5/166; A43B 5/0427; A43B 5/0435; A43B 5/045; A43B 5/048; A43B 5/0452; A43B 5/0429; A43B 5/0447; A43B 5/0449; A43B 5/0456; A43B 5/046; A43B 3/16; A43B 3/26; A43B 7/125
USPC ..... 36/72 A, 72 R, 73, 97, 117.7, 118.1, 36/7.1 R, 96, 117.8, 50.1, 50.5
See application file for complete search history.

(56) References Cited

U.S. PATENT DOCUMENTS 492,272 A * 2/1893 Comfort ..... A43B 3/0031 36/1
515,173 A * 2/1894 Scholding ..... A43B 3/0031 36/1
1,110,045 A * 9/1914 Dalton ..... A43B 7/32 36/72 R
1,458,497 A * 6/1923 Perkins ..... A43C 15/066 36/7.6
1,539,762 A * 5/1925 Mussabini ..... A43B 3/10 36/129
1,832,866 A * 11/1931 Johnson ..... A63C 3/00 280/811
2,112,052 A * 3/1938 Smith ..... A43B 3/26 36/100
2,523,449 A * 9/1950 Rosenzweig ..... A43B 3/26 36/102
3,640,003 A * 2/1972 Anderson ..... A43B 5/0405 12/142 P
3,834,048 A * 9/1974 Maurer ..... A43C 11/16 24/575.1
4,624,015 A * 11/1986 Bottoms ..... A43B 5/00 2/22
4,633,599 A * 1/1987 Morell ..... A43C 11/16 24/68 SK
4,653,204 A * 3/1987 Morell ..... A43C 11/16 24/68 SK
4,660,300 A * 4/1987 Morell ..... A43C 11/16 24/68 SK
4,672,755 A * 6/1987 Benoit ..... A43B 5/04 24/68 SK
4,677,768 A * 7/1987 Benoit ..... A43B 5/0433 24/68 SK
4,680,878 A * 7/1987 Pozzobon ..... A43B 5/0433 24/68 B
4,698,920 A * 10/1987 Benoit ..... A43B 5/0433 24/68 SK
4,719,709 A * 1/1988 Vaccari ..... A43B 5/0433 36/117.8

(Continued)

OTHER PUBLICATIONS

Skate Fenders home page, found at http://www.skatefenders.com/home.html, retrieved on Sep. 16, 2014, 1 p.

*Primary Examiner* — Shaun R Hurley
*Assistant Examiner* — Bao-Thieu L Nguyen
(74) *Attorney, Agent, or Firm* — Brooks, Cameron & Huebsch, PLLC

(57) ABSTRACT

A protective cover for an article of footwear can include a first portion covering the top and sides of the footwear and a second portion covering the back of the footwear. The first portion can include locations to receive at least part of a connecting mechanism, and the second portion of the cover can be connected to the first portion of the cover by the connecting mechanism.

20 Claims, 9 Drawing Sheets

(56) References Cited

U.S. PATENT DOCUMENTS 4,719,710 A * 1/1988 Pozzobon ..... A43C 11/16 24/68 B
4,790,081 A * 12/1988 Benoit ..... A43B 5/0433 24/68 SK
4,823,485 A * 4/1989 Kemmer ..... A43B 5/0435 36/117.8
4,893,419 A * 1/1990 Arieh ..... A43B 5/0449 36/118.1
4,928,407 A * 5/1990 Ottieri ..... A43B 5/048 36/117.3
4,937,953 A * 7/1990 Walkhoff ..... A43B 5/0449 36/117.7
4,949,479 A * 8/1990 Ottieri ..... A43B 5/0435 36/117.1
4,955,149 A * 9/1990 Ottieri ..... A43B 5/048 36/117.8
4,959,914 A * 10/1990 Hilgarth ..... A43B 3/26 36/117.1
4,969,278 A * 11/1990 Ottieri ..... A43B 5/0435 36/117.8
5,003,711 A * 4/1991 Nerrinck ..... A43B 5/0449 36/118.1
5,060,403 A * 10/1991 Battistella ..... A43B 5/0415 36/118.1
5,065,481 A * 11/1991 Walkhoff ..... A43C 11/16 24/68 SK
5,127,171 A * 7/1992 Stampacchia ..... A43B 5/04 36/118.1
5,167,083 A * 12/1992 Walkhoff ..... A43B 5/0449 36/118.2
5,177,885 A * 1/1993 Marmonnier ..... A43B 5/04 36/118.9
5,249,377 A * 10/1993 Walkhoff ..... A43C 11/16 36/117.7
5,272,823 A * 12/1993 Perrissoud ..... A43B 5/0447 36/117.7
5,381,609 A * 1/1995 Hieblinger ..... A43C 11/165 36/50.1
5,381,612 A * 1/1995 Paris ..... A43B 5/0433 36/117.7
5,412,883 A * 5/1995 Wulf ..... A63C 9/086 280/613
5,481,814 A * 1/1996 Spencer ..... A43B 11/00 36/103
5,638,614 A * 6/1997 Hardy ..... A43B 3/16 36/113
5,720,119 A * 2/1998 Benoit ..... A43B 5/0433 36/117.1
5,829,170 A 11/1998 Lutz, Jr.
7,386,947 B2 * 6/2008 Martin ..... A43B 5/0401 36/10
7,523,567 B1 4/2009 McClellan
8,468,657 B2 * 6/2013 Soderberg ..... A43C 11/16 24/68 SK
8,869,434 B2 * 10/2014 Peraro ..... A43B 3/26 36/117.3
2002/0178616 A1 * 12/2002 Williams ..... A43B 5/00 36/97
2003/0097770 A1 * 5/2003 Karasawa ..... A43B 3/06 36/97
2003/0213149 A1 * 11/2003 Woods ..... A43B 3/00 36/110
2005/0022430 A1 * 2/2005 Terry ..... A43B 1/0081 36/72 R
2005/0081407 A1 * 4/2005 Tsuji ..... A43B 3/163 36/72 R
2006/0230638 A1 * 10/2006 Cavasin ..... A43B 5/04 36/117.3
2008/0066272 A1 * 3/2008 Hammerslag ..... A43C 11/14 24/712
2012/0010547 A1 * 1/2012 Hinds ..... A61F 5/013 602/21
2012/0011742 A1 * 1/2012 Yang ..... A43B 5/0427 36/45
2014/0373393 A1 * 12/2014 Tronchin ..... A43B 5/0433 36/115

* cited by examiner

PROTECTIVE COVER FOR AN ARTICLE OF FOOTWEAR

BACKGROUND

Even with modern protective footwear, ankle and foot injuries can be sustained in many activities and areas of work. Such injuries can result to a foot as a result of contact between the foot and another object. For example, a hockey player's foot may be injured when contacted by a hockey stick or puck, or a machinist's foot may be injured when contacted by a tool or a part.

Protecting the foot from injury can be difficult due to a number of factors. One such factor is that footwear is frequently designed with a minimal amount of protection from such injury, especially on the top and back of the footwear. Some specialized types of footwear, for example, ice hockey skates and steel-toed boots, often provide some protection against injury to some parts of the foot, but can fail to provide adequate protection to the top, sides, and back of the foot, as well as the ankle. This lack of protection can result in injuries to the foot, for example, tissue bruising, bone fractures, and lacerations.

Currently available devices which attempt to protect the foot from injury suffer from a number of shortcomings. Examples of such shortcomings include devices that are too heavy, devices that fail to protect the entire foot, devices that hinder a wearer's range of motion, and devices that do not fit snugly to the footwear, or are uncomfortable or ill-fitting.

Strap-on and tie-on type protectors for the ankle portion of footwear exist. For example, leather has been combined with cardboard and/or plastic to fabricate protective cups that can be strapped or tied onto the exterior of a piece of footwear to protect a wearer's ankle.

U.S. Pat. No. 5,829,170 to Lutz, Jr. describes a removable protective shell cover molded into a boot-fitting shape. This shell cover covers the upper sides and tongue portion of the boot and partially covers the side portions of the boot. The shell cover is fastened by a strap that runs under the boot and by a strap that runs behind the ankle around the Achilles tendon. The straps each have a pad on one end to create a gap between the between the shell and the boot in an attempt to allow the shell to dissipate forces resulting from an impact to the cover. In addition, the laces of the skate are specifically used to facilitate the gap between the cover and the boot.

U.S. Pat. No. 7,523,567 to McClelland describes a removable protective cover for a hockey skate boot. The removable protective cover covers the sides, tongue, and partially covers ankle portions of the boot. The protective cover includes heel-cupping sidewall portions that flex apart diagonally to apply the cover to a boot and to secure the protective cover in place while a user operates straps to fasten the protective cover to the boot. One strap runs under the boot, and another strap runs behind the ankle around the Achilles tendon. Spaced pads are placed on the inside of the protective cover to create a gap between the protective shell and the boot in an effort to allow the shell to dissipate impact forces from the protective cover.

In contrast, various examples described below provide for a lightweight, removable protective footwear cover that can protect the entire foot from injury while allowing the wearer to maintain their range of motion.

DETAILED DESCRIPTION

The present disclosure is directed to a light-weight, two-piece, removable hard-shell protective cover that can be worn over an article of footwear. The protective cover can cover the top, sides, ankles, and back of the footwear. In operation, the two pieces of the cover can be secured together by a connecting mechanism. In one example, the two pieces of the cover can be secured by a system of cables that can be tensioned to hold the two pieces of the cover together. The preferred material for the cover is relatively hard but flexible material such as a thermoplastic polymer. The first piece of the cover can be formed in one portion and can have a vertically split heel contiguous with a substantially open bottom. The sides of the first piece of the cover can cup (e.g., partially enclose) part of the bottom of the footwear. The second piece of the cover can be formed in one portion and can have a concave portion to cover the back of the footwear. The bottom of the second piece of the cover can cup part of the heel portion of the footwear. In operation, the cover can be suspended above the footwear via an adjustable strap to disperse the impact of an object that comes in contact with the cover.

These and other features and advantages of the present disclosure will become apparent on further reading of the detailed description below, in light of the accompanying drawings.

Figure 1:
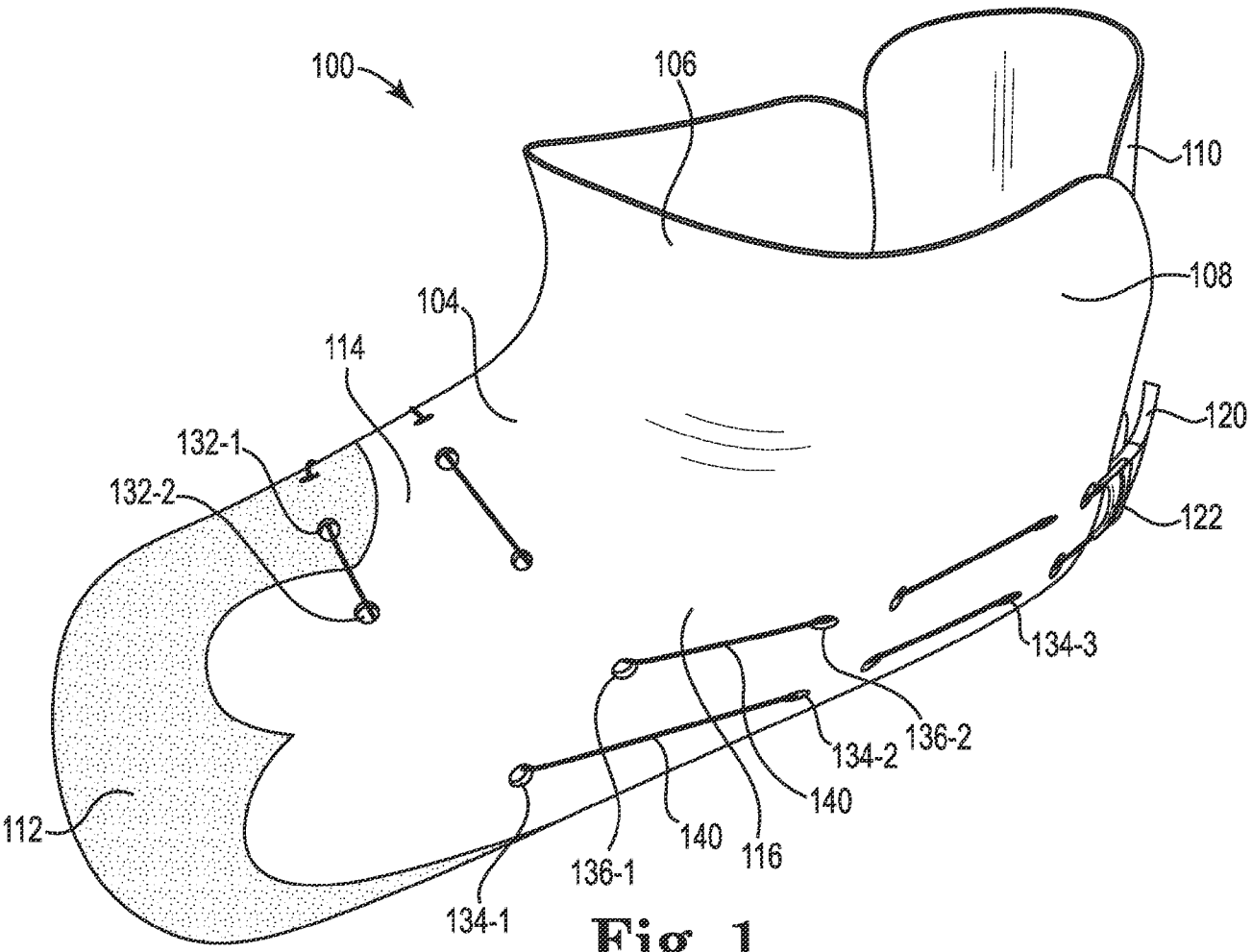
FIG. 1 illustrates a front perspective view of an example of a protective cover for an article of footwear according to the present disclosure.

FIG. 1 illustrates a front perspective view of an example of a protective cover for an article of footwear according to the present disclosure. The footwear cover 100 can include a first portion 104 and a second portion 110. The first portion 104 and the second portion 110 can be connected by a connecting mechanism. In some examples, the connecting mechanism can include a cable 140 connected at one end to a flange 122 and connected at the other end to a reel that can be connected to, and actuated by, a rotatable knob (e.g., rotatable knob 229 illustrated in FIG. 2). The cable 140 can be a single piece of cable connected at one end to its beginning. For example, cable 140 can be a loop. In this regard, one end of the loop can be connected to the flange 122, and the other end of the loop can be connected to a reel (e.g., reel 280 illustrated in FIG. 2) or reel-type mechanism. Embodiments are not so limited, however, and the connecting mechanism can include straps, VELCRO®, strap in bindings, etc. For example, the first portion 104 and the second portion 110 can be connected by strap in bindings and/or VELCRO® straps.

The first portion 104 and the second portion 110 can be formed and/or molded as two separate pieces, for example, the first portion 104 can be a one-piece shell and the second portion 110 can be a separate one-piece shell. Examples are not so limited, however, and the cover can be formed in more than two pieces. In some examples, the first portion 104 and the second portion 110 can be molded or formed from carbon fiber. However, other moldable or formable materials and/or combinations thereof can be used, for example, plastic, fiberglass, KEVLAR®, carbon-fiber reinforced thermoplastic, etc. In some examples, the material(s) used to form the first portion 104 and the material(s) used to form the second portion 110 can be different. In some examples, the first portion 104 and the second portion 110 can be manufactured using a compression molding procedure. In addition, in some examples, the cover 100 can be formed using a computer-aided manufacturing process. For example, the cover 100 can be formed using a computer-aided design/computer-aided manufacturing (CAD/CAM) process. In some examples, the cover 100 can be formed using additive manufacturing or 3D printing, for example, stereolithography, optical fabrication, selective laser sintering, fused deposition modeling, etc., as described in more detail herein in connection with FIGS. 9 and 10.

The cover 100 can be formed of unitary thickness, however, as will be appreciated by one skilled in the art, the cover 100 can be formed of varying thickness. That is, the thickness of first portion 104 and second portion 110 can be different. In some examples, first portion 104 and/or second portion 110 can be of a varying thickness throughout. For example, upper surface portion 114 can be formed with a greater thickness than toe portion 112. As a further example, the first portion 104 can be formed of unitary thickness and the second portion 110 can be formed of varying thickness. In this regard, the weight and strength of the cover 100 can be altered to provide adequate protection for a number of activities and/or areas of work while minimizing the weight of the cover 100.

The cover 100 can be manufactured to fit over a single size and/or type of footwear; however, it will be appreciated by those of ordinary skill in the art that the cover 100 can be manufactured to fit over more than one size and/or type of footwear, and that the shape and/or proportions of the example cover 100 can be different than those shown in the example illustrations. In some examples, the cover can be manufactured using a just in time production strategy. The cover 100 can also be manufactured with different colors, graphics, and/or other ornamental features to alter the appearance of the cover 100. For example, a vinyl graphic can be applied to the cover 100 and/or the material used to make the cover 100 can be dyed or otherwise colored.

In some examples, the cover 100 can be formed by forming a first portion 104 covering a top portion, side portions, and an ankle portion of a piece of footwear. In some examples, the first portion 104 can be formed from more than one piece, and the pieces can be fastened together, for example using adhesives, fasteners, snap-together tabs, etc. to form first portion 104. A plurality of locations to receive at least a portion of a connecting mechanism disposed along the first cover portion can also be provided. The second piece of the cover 100 can be provided by forming a second portion 110 covering a back portion of the piece of footwear. In some examples, to connect the first portion 104 and second portion 110, a connecting mechanism having a cable 140 attached at a first end to a connector and attached at a second end to a reel (e.g., reel 280 illustrated in FIG. 2), where the cable 140 is received by the plurality of locations to receive the cable, and where the connector is disposed on a first side of the second portion 110 and the reel (e.g., reel 280 illustrated in FIG. 2) is disposed on a second side of the second portion 110 can be formed. In some examples, first portion 104 and/or second portion 110 can include padding to provide spacing between the cover 100 and the article of footwear and/or to provide cushioning.

Figure 2:
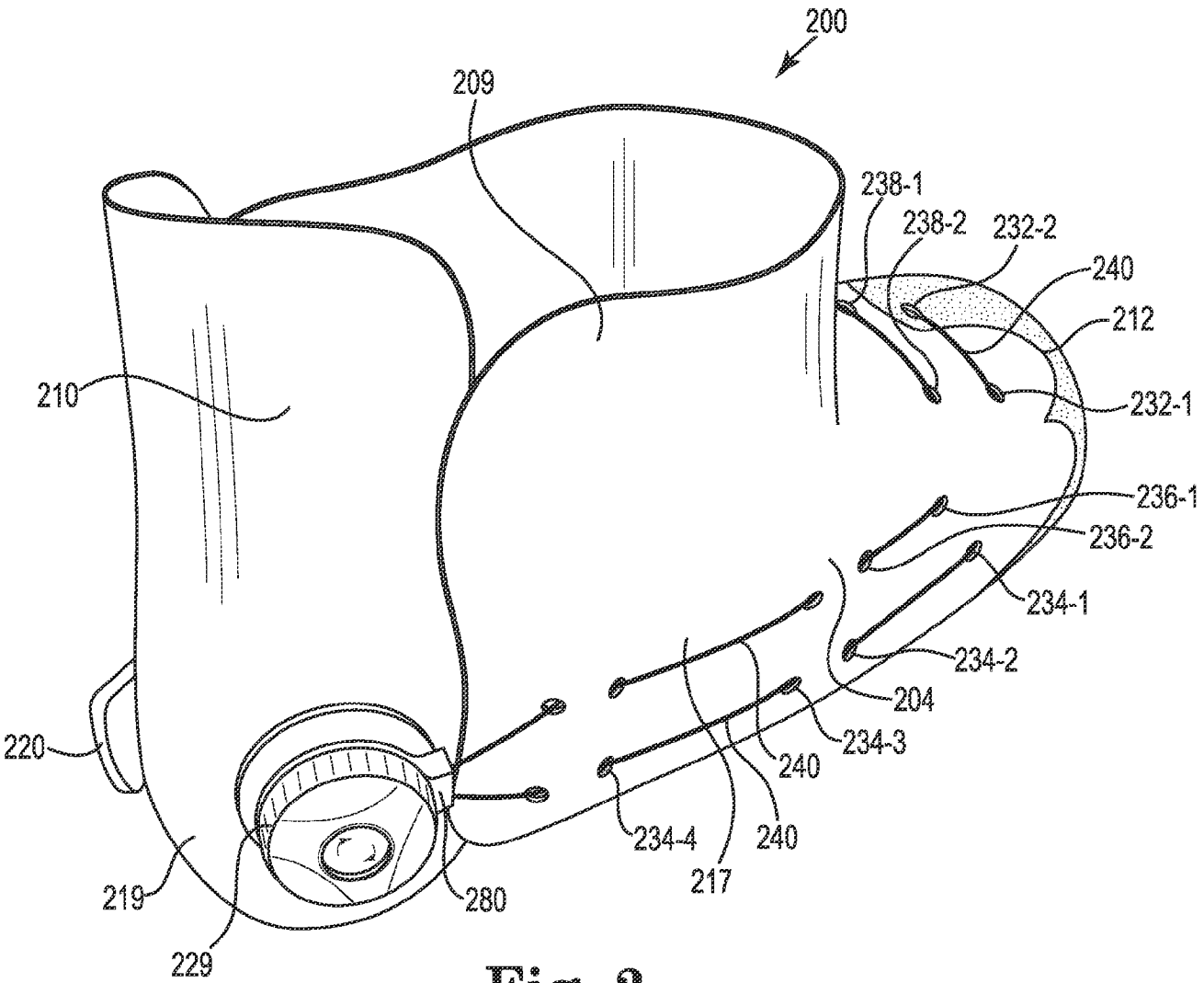
FIG. 2 illustrates a rear perspective view of an example of a protective cover for an article of footwear according to the present disclosure.

The first portion 104 can have an upper surface portion 114, a first side surface 116, and a second side surface (e.g., side surface 217 illustrated in FIG. 2). In addition, a front ankle protection portion 106, a first side ankle protection portion 108, and a second side ankle protection portion (e.g., 209 illustrated in FIG. 2) can be provided. At intervals along the first side surface 116, the second side surface (e.g., side surface 217 illustrated in FIG. 2), and the upper surface portion 114 of the first portion 104, at least a portion of the connecting mechanism can be constrained to the first portion 104. For example, a plurality of locations to receive at least a portion of the connecting mechanism can be provided along the first portion 104 and/or second portion 110. In some examples, the portion of the connecting mechanism provided along the first portion 104 and/or second portion 110 can be a cable 140 that can be constrained to the first portion 104. In some examples, the locations to receive at least a portion of the connecting mechanism can be a plurality of apertures 134-1, 134-2, . . . , 134-N to guide the cable 140 and constrain the motion of the cable 140 to the first portion 104. Similarly, at intervals along the upper surface portion 114 a plurality of apertures 132-1, 132-2, . . . , 132-N can be provided to guide and constrain the cable 140 to the first portion 104. In some examples, a cable 140 can be passed through the apertures 132-1, 132-2, . . . , 132-N, and 134-1, 134-2, . . . , 134-N to connect the cable 140 to the cover 100. Examples are not so limited, however, and the cable 140 can be constrained to the first portion 104 by other mechanisms, for example, grommets, eyelets, etc.

As noted above, the second portion 110 can be connected to the first portion 104 via a cable 140. One end of the cable 140 can be connected to a flange 122, and the other end of the cable 140 can be connected to a reel (e.g., reel 280 illustrated in FIG. 2) or reel-type mechanism. An example of a suitable reel-type mechanism is described in U.S. Pat. No. 7,992,261 to Hammerslag et al.

A tab 120 can be connected to the flange 122. In some examples, the flange 122 can be connected to the tab 120, which can be provided to aid in securing or removing the cover 100. For example, as described in more detail herein, flange 122 can be secured to a flange connector (e.g., flange connector 524 illustrated in FIG. 5) that is affixed to the second portion 110. In some examples, the flange connector (e.g., flange connector 524 illustrated in FIG. 5) can be connected to the second portion 110 so that it is non-movable. The cover 100 can be tightened or loosened by operating the connecting mechanism. The connecting mechanism can include a flange 122, a rotatable knob (e.g., rotatable knob 229 illustrated in FIG. 2), a reel (e.g., reel 280 illustrated in FIG. 2), and a cable 140, which are shown and discussed in more detail herein in connection with FIGS. 5, 7, and 8. In some examples, the connecting mechanism can be a Boa® closure system.

FIG. 2 illustrates a rear perspective view of an example of a protective cover for an article of footwear according to the present disclosure. In the example of FIG. 2, a second portion 210 can be connected to the first portion 204 via a cable 240 disposed in a reel 280 that can be connected to a rotatable knob 229. The cable 240 shown in FIG. 2 can be the same continuous cable 140 shown in FIG. 1. In some examples, the cable 240 can be received by the plurality of locations to receive at least a portion of the connecting mechanism described above. In the example of FIG. 2, the cable 240 can be passed through the plurality of apertures 234-1, 234-2, . . . , 234-N along a lower path of the first portion (e.g., first portion 104 illustrated in FIG. 1) such the cable 240 alternates between being on the outside of the cover 200 and on the inside of the cover 200. That is, the cable 240 can be passed through aperture 234-4 so that the cable 240 is on the outside of the first portion (e.g., first portion 104 illustrated in FIG. 1). The cable 240 can then be passed through aperture 234-3 such that the cable 240 is on the inside of the first portion (e.g., first portion 104 illustrated in FIG. 1). The cable 240 can then be passed through aperture 234-2 such that the cable is on the outside of the first portion (e.g., first portion 104 illustrated in FIG. 1). Similarly, the cable 240 can be woven through the plurality of apertures 236-1, 236-2, . . . , 236-N dispersed along an upper path of the first portion (e.g., first portion 104 illustrated in FIG. 1) such that the cable 240 is alternately on the inside and outside of the first portion (e.g., first portion 104 illustrated in FIG. 1). In addition, the cable 240 can be passed through the other apertures of the plurality of apertures 236-1, 236-2, . . . , 236-N, 238-1, 238-2, . . . , 238-N located along the first portion (e.g., first portion 104 illustrated in FIG. 1) of the cover 200 for the continuous loop of the cable 240. In some examples, the cable 240 can pass through one of the plurality of apertures 234-1, 234-2, . . . , 234-N along a lower path of the first portion (e.g., first portion 104 illustrated in FIG. 1) such that the cable is on the inside of the first portion (e.g., first portion 104 illustrated in FIG. 1). The cable can then be passed through the next aperture e.g., 234-2 of the plurality of apertures such that the cable is on the outside of the first portion (e.g., first portion 104 illustrated in FIG. 1). In this regard the cable 240 can be passed in and out of the first portion (e.g., first portion 104 illustrated in FIG. 1) such that the cable 240 can be constrained to the first portion (e.g., first portion 104 illustrated in FIG. 1).

Figure 3:
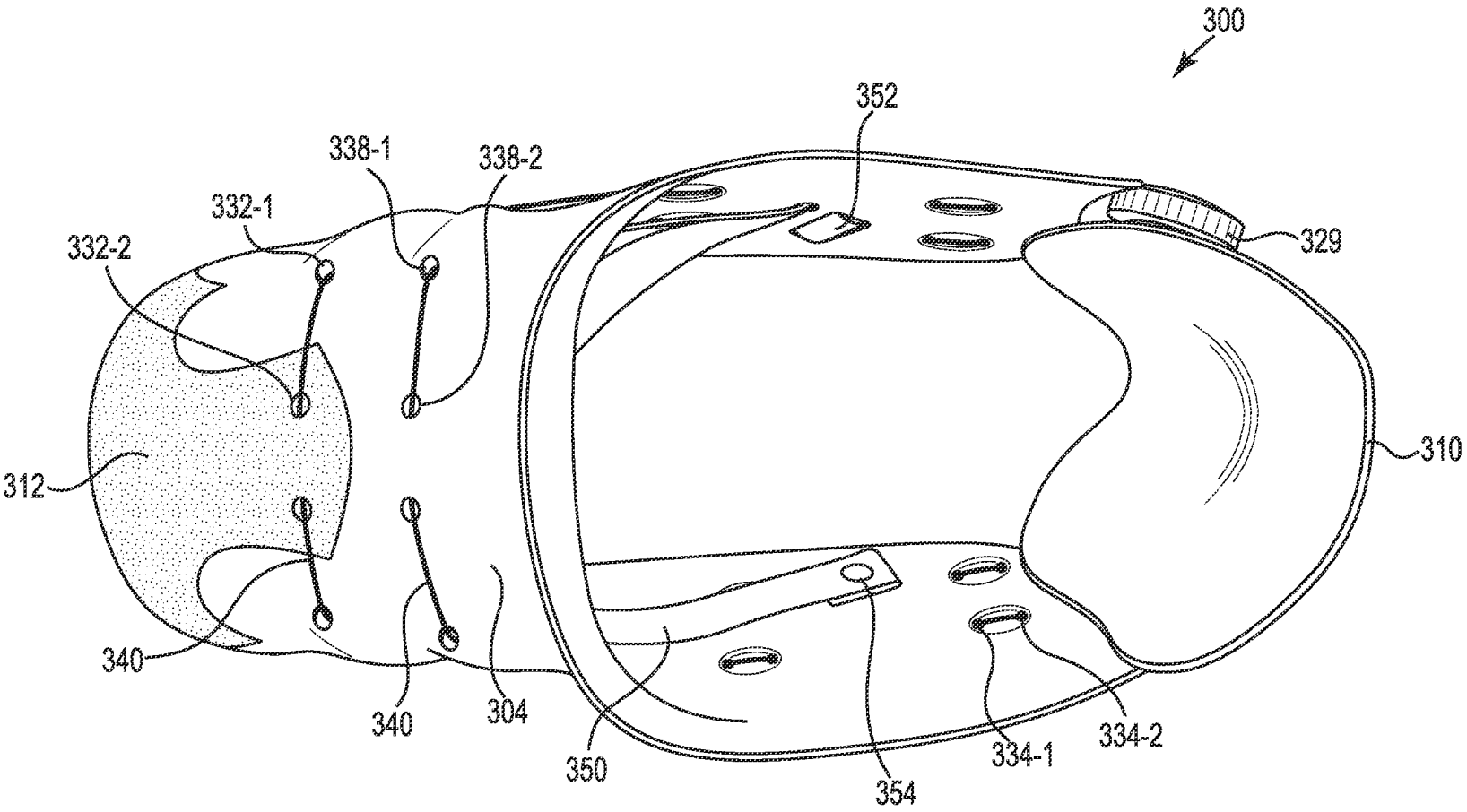
FIG. 3 illustrates a top view of an example of a protective cover for an article of footwear according to the present disclosure

FIG. 3 illustrates a top view of an example of a protective cover for an article of footwear according to the present disclosure. In the example of FIG. 3, a suspension mechanism 350 can be connected to the first portion 304. The suspension mechanism 350 can prevent the cover 300 from moving once the cover 300 is installed over the footwear. The suspension mechanism 350 can include a strap, webbing, or other similar mechanism that can suspend the first portion 304 of the protective cover 300 above the footwear. In some examples, one end of the suspension mechanism 350 can be affixed to the first portion 304 on one side of the first portion 304, for example at 354, and the other end of the suspension mechanism 350 can connect to the other side of the first portion 304, for example at 352. For example, the suspension mechanism 350 can include a strap, where a first end of the strap is connected to a first interior side of the sidewall portion (e.g., side portion 116 illustrated in FIG. 1), and a second end of the strap is connected to a second interior side of the sidewall portion (e.g., side portion 217 illustrated in FIG. 2), where the suspension mechanism 350 can provide a space between the first portion 304 of the cover 300 and the footwear. Examples are not so limited, however, and suspension mechanism 350 can include pads, air bladders, or other such mechanisms that can allow for space between the cover 300 and the article of footwear. In some examples, a second suspension mechanism (not shown) can be provided to the second portion 310 of the protective cover 300 to position the second portion 310 of the cover such that the second portion 310 of the protective cover 300 is not in direct contact with the back of the footwear.

The suspension mechanism 350 can be adjustable. For example, suspension adjustment mechanism 352 can be provided to allow for adjustment of the suspension mechanism length to alter the distance between at least the first portion 304 of the cover 300 and the footwear. In some examples, the suspension mechanism 350 can be tensionable to alter the length of the suspension mechanism 350. For example, an adjustable strap can be fixed to one side (e.g., first sidewall portion 116 illustrated in FIG. 1) of the two opposing side surfaces (e.g., sidewall 116 illustrated in FIG. 1 and sidewall 217 illustrated in FIG. 2) to the other side (e.g. second sidewall portion 217 illustrated in FIG. 2) of the two opposing side surfaces (e.g., sidewall 116 illustrated in FIG. 1 and sidewall 217 illustrated in FIG. 2) to provide spacing between at least the first portion 304 of the cover 300 and the footwear. The adjustable strap can be adjustable by tensioning on an opposite side of the two opposing side surfaces (e.g., sidewall 116 illustrated in FIG. 1 and sidewall 217 illustrated in FIG. 2). In this manner, the first portion 304 of the cover 300 can be positioned such that the first portion 304 of the cover 300 is not in direct contact with the footwear. Thus, forces resulting from impact to the cover 300 can be dispersed and transferred away from the footwear. In addition, the footwear can be protected from damage caused by wear and tear that could result from the footwear being in direct contact with the cover 300. In some examples, suspension adjustment mechanism 352 can be a part of the first portion 304. For example, suspension adjustment mechanism 352 can be a taber buckle formed into the first portion 304. Embodiments are not so limited, however, and suspension adjustment mechanism 352 can be a separate part mounted to the first portion 304. The suspension adjustment mechanism 352 can include a spring buckle strap, a cam strap, side release buckle, jam lever buckle, or other mechanism that can be used to alter the length of the suspension mechanism 350. Suspension mechanism 350 can be manufactured from polypropylene, nylon, polyester, and/or elastic, for example. However, it will be appreciated by one skilled in the art that combinations of these materials and/or other materials with similar properties can be used to make the suspension mechanism 350. In some examples, the suspension mechanism 350 can be manufactured by forming a strap having a connection 354 to a first side of the first portion 304 and a connection 352 to the second side of the first portion 304.

Figure 4:
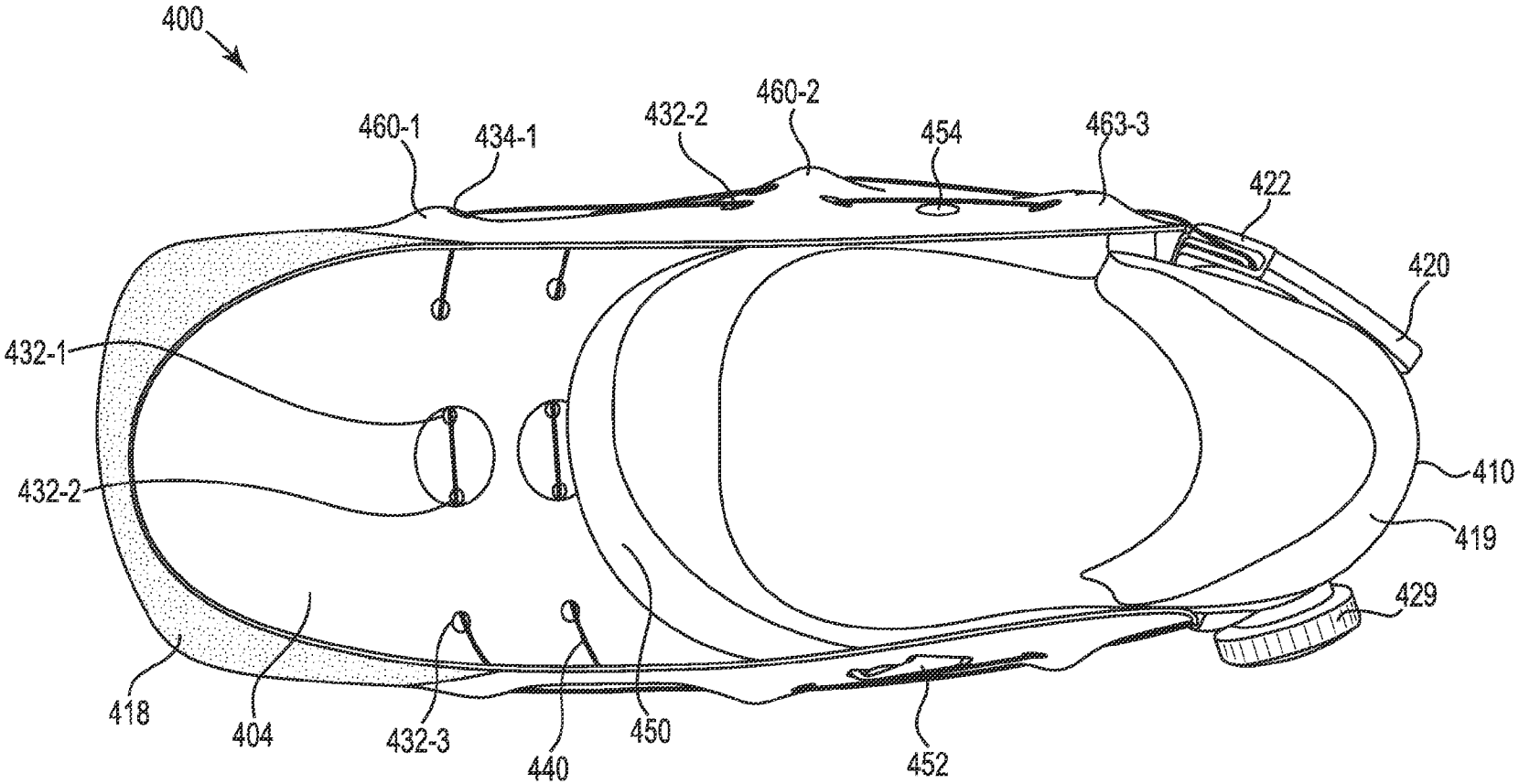
FIG. 4 illustrates a bottom view of an example of a protective cover for an article of footwear according to the present disclosure.

FIG. 4 illustrates a bottom view of an example of a protective cover for an article of footwear according to the present disclosure. In the example of FIG. 4, the protective footwear covering 400 can include a first portion 404, a second portion 410, a connecting mechanism, and a suspension mechanism 450. In some examples, the first portion 404 can be a one-piece shell covering the top and sides of the footwear. In addition, the first portion 404 can include an upper surface (e.g., upper surface 114 illustrated in FIG. 1), two opposing side surfaces (e.g., 116 illustrated in FIGS. 1 and 217 illustrated in FIG. 2), and can include a plurality of apertures 432-1, 432-1, . . . , 432-N, 434-1, 434-2, . . . , 434-N, etc. The side surfaces can be sidewalls (e.g. first sidewall 116 illustrated in FIG. 1 and second sidewall 217 illustrated in FIG. 2) that cover the side and ankle portions (e.g., ankle portion 106 illustrated in FIG. 1, first side ankle portion 108 illustrated in FIG. 1, and second side ankle portion 209 illustrated in FIG. 2) of the footwear. The second portion 410 can be a one-piece shell covering the back of the footwear. Second portion 410 can be narrower than the side portions (e.g., 116 illustrated in FIGS. 1 and 217 illustrated in FIG. 2) such that second portion 410 can be at least partially inside first portion 404 after the cover 400 has been secured. In some examples, the second portion 410 can include a connecting mechanism. The connecting mechanism can include a flange 422, a rotatable knob 429, and a cable 440. In some examples, the flange 422 can be disposed on one side of the second portion 410, and the rotatable knob 429 can be disposed on the opposite side of the second portion 410. As will be appreciated by one skilled in the art, the flange 422 and the rotatable knob 429 can be disposed on either side of the second portion 410 so long as they are on opposite sides of the second portion 410. The cable 440 can have a first end connected to a flange 422 and a second end connected to a reel-type mechanism (e.g., reel 280 illustrated in FIG. 2). In some examples, the tab 420 can be provided to the flange 422 to aid in disengaging the flange 422 from a flange connector (e.g., flange connector 524 illustrated in FIG. 5). In addition, in some examples, suspension mechanism 450 can be provided to provide spacing between the cover 400 and the footwear. In some examples, the suspension mechanism 450 can include an adjustable strap connecting from the inside of the first side surface (e.g., first side surface 116 illustrated in FIG. 1) to the inside of the second side surface (e.g., second side surface 217 illustrated in FIG. 2). In some examples, suspension mechanism 450 can be provided to hold the cover first portion 404 in place on the article of footwear.

The side portions (e.g., 116 illustrated in FIGS. 1 and 217 illustrated in FIG. 2) of the cover 400 can be formed such that a plurality of a extrusions 460-1, 460-2, . . . , 460-N extrude from the cover 400. In some examples, the plurality of extrusions can be formed along the first portion 404. In some examples, locations to receive at least a portion of the connecting mechanism can be provided at or near the plurality of extrusions. In the example where the plurality of location to receive at least a portion of the connecting mechanism are apertures, the plurality of apertures (e.g., 434-1, 432-2, etc.) can be located at the base of each of the plurality of extrusions 460-1, 460-2, . . . , 460-N. This can allow for the plurality of apertures (e.g., 432-1, 432-3, etc. and 434-1, 434-2, etc.) to be formed in to the first portion 404 of the cover 400 without the need for, for example, additional fasteners. The plurality of extrusions 460-1, 460-2, . . . , 460-N can be formed such that they extend outward from the cover 400. In this manner, the plurality of extrusions 460-1, 460-2, . . . , 460-N can be formed so as not to interfere with the article of footwear. In some examples, the extrusions 460-1, 460-2, . . . , 460-N can be provided to increase or decrease the tensile strength of the cover 400.

In operation, a user can slide the first portion 404 of the cover 400 over their footwear. In some examples, a cupped portion 418 of the first portion 404 can engage the bottom of the footwear so that the cover 400 is held substantially fixed with regard to a vertical plane. Similarly, the second portion 410 can include a cupped portion at its bottom to cup the bottom heel portion of the article of footwear. In some examples, the first portion 404 and/or the second portion 410 can be directly connected to the bottom of the footwear. For example, first portion 404 can be provided with a plurality of rivets to affix the first portion 404 to the bottom of the footwear. In some examples, first portion 410 and/or second portion 404 can be provided with projections and recesses such that first portion 410 and/or second portion 404 can engage (e.g., attach to) the bottom of the footwear and/or a housing (e.g., a skate-blade tower, etc.) that can be attached to an article of footwear. In this regard, the cover 400 can be semi-permanently or permanently connected to the article of footwear.

When the first portion 404 of the cover 400 is in place over the article of footwear, flange 422 can be inserted into flange connector 424, for example, by operating tab 420 to align the flange 422 with the flange connector 424 and actuating the connecting mechanism, as described in more detail in connection with FIGS. 7 and 8. When the flange 422 is securely seated in the flange connector 424, the rotatable knob 429 can be operated to tighten the cable 440.

Figure 5:
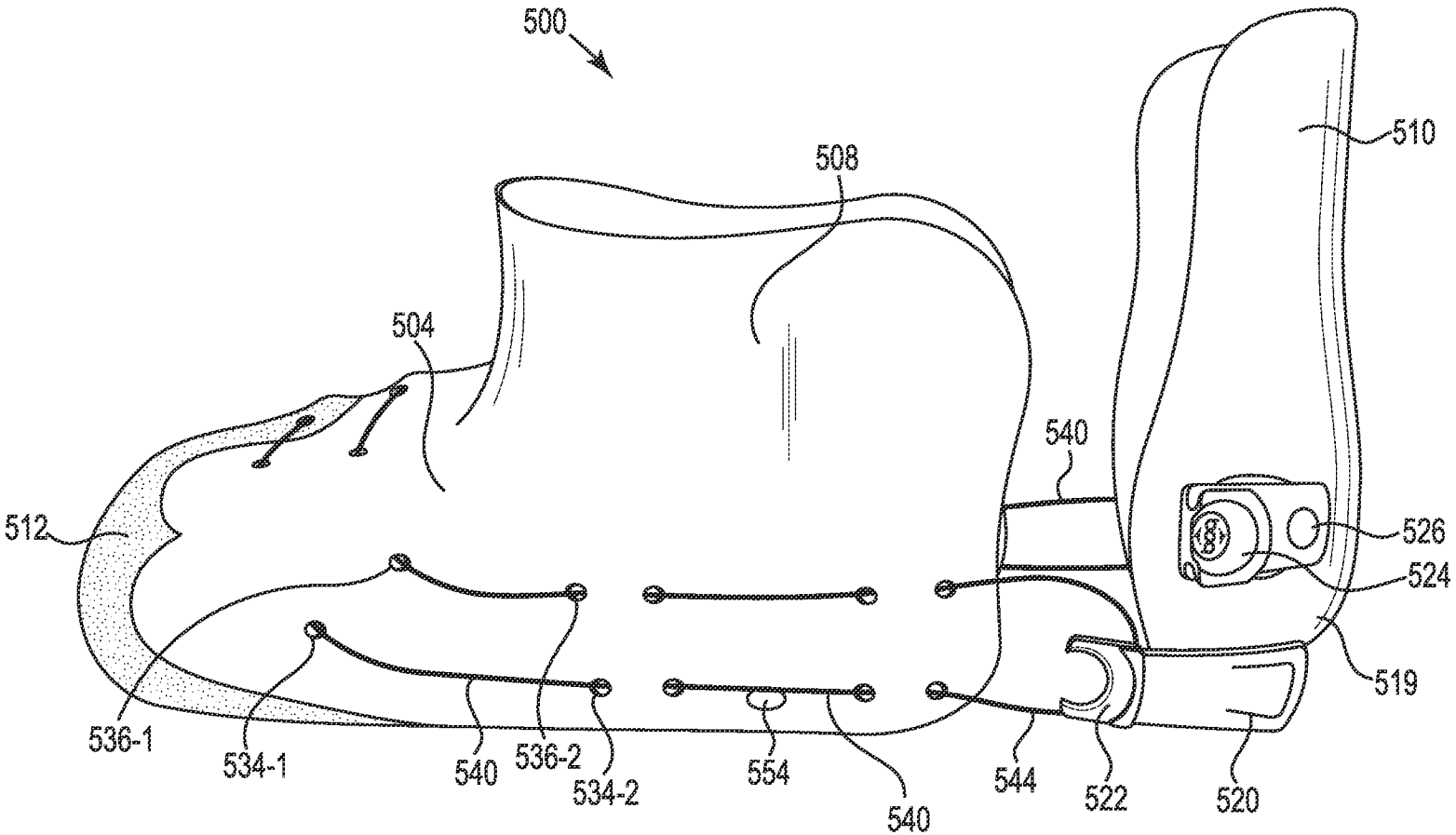
FIG. 5 illustrates a side view of an example of a protective cover for an article of footwear according to the present disclosure.

FIG. 5 illustrates a side view of an example of a protective cover for an article of footwear according to the present disclosure. In the example of FIG. 5, the tension in the cable 540 has been slackened to illustrate operation and detachment of the cover 500. As shown in the example of FIG. 5, the flange 522 is no longer connected to, or in direct contact with, the flange connector 524 to permit the first portion 504 and the second portion 510 to open and move apart to allow the cover 500 to be placed around, or be removed from, an article of footwear. That is, slackening the tension in the cable 540 can be done to allow for the cover 500 to be removed from the footwear or installed (e.g., put on) over the footwear. As described more in connection with FIGS. 7 and 8, the tension can be slackened in the cable 540 by actuating the rotatable knob (e.g., rotatable knob 429 illustrated in FIG. 4) and/or by pulling on the tab 520 to disengage the flange 522 from the flange connector 524. In some examples, the first portion 504 and the second portion 510 can remain connected by the cable 540 on an opposite side. In this regard, the first portion 504 and the second portion 510 can remain connected to prevent complete separation or loss of one portion of the cover 500.

As noted above, the cable 540 can be comprised of a single, continuous piece of material. Suitable materials for use as the cable 540 can include various alloys (e.g., copper, aluminum, nickel, titanium, etc.), steels (e.g., high carbon steel, brass plated steel, etc.), and/or composite cable. One end of the cable 540 can be connected in a loop at the flange 522 to provide a connection between the flange 522 and the looped end of the cable 544 on a first side of the second portion 510. The other end of the cable 540 can be disposed inside the reel (e.g., reel 780 illustrated in FIG. 8) on a second side of the second portion 510. In some examples, the cable 544 can be connected in a loop at the flange 522 by being molded directly into the flange 522. The flange can be made of a standard grade rubber or other shaped material. However, examples are not so limited to the examples given herein, and the cable 540 can be connected to the flange 522 with an adhesive, solder, brazed connection, or other such joining technique.

Turning back to the example of FIG. 5, the bottom portion of the second portion 510 of cover 500 can include a cupped portion 519. Cupped portion 519 can partially wrap around and/or under a heel portion of the footwear and can provide protection to the heel portion of the footwear. For example, second portion 510 can provide protection against injury that could occur as a result of the back portion of the footwear coming into contact with a hockey stick, hockey puck, and/or other object. In some examples, cupped portion 519 can aid in fitting the cover 500 to the footwear and can aid in at least partially securing the cover 500 to the footwear.

Figure 6:
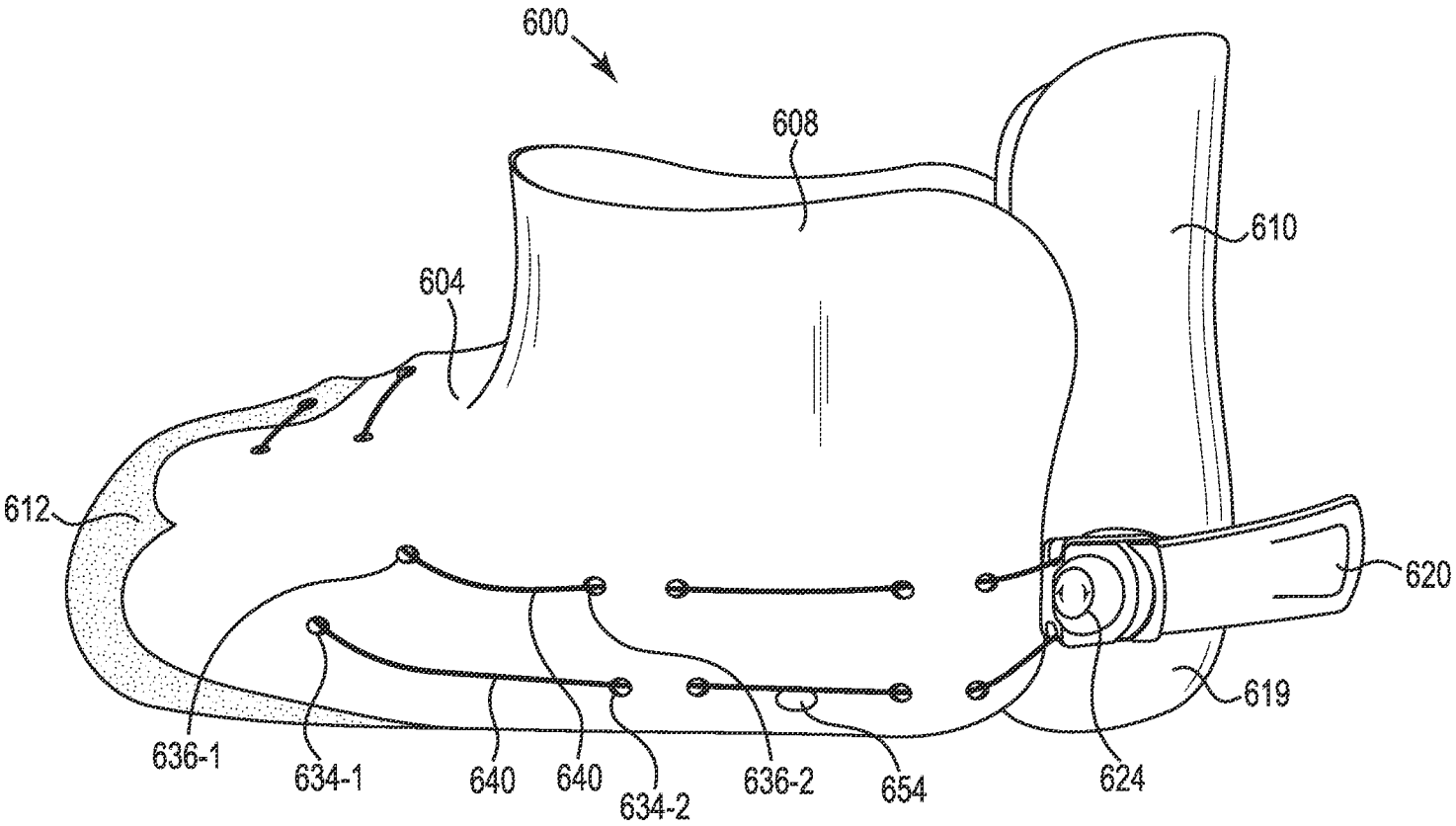
FIG. 6 illustrates a side view of an example of a protective cover for an article of footwear according to the present disclosure.

FIG. 6 illustrates a side view of an example of a protective cover for an article of footwear according to the present disclosure. In the example of FIG. 6, the first portion 604 and the second portion 610 are shown in an attached or connected state. That is, the example of FIG. 6 shows a state where the cover 600 is placed over the footwear and secured thereto.

The connecting mechanism can be tightened to connect the first portion 604 and the second portion 610. For example, the cable 640 can be tightened, as described in more detail in connection with FIGS. 7 and 8, to bring the second portion 610 in close proximity to, or in partial contact with, the first portion 604. In some examples, tightening the cable 640 in this fashion can be done after the footwear is encased by the cover 600.

Figure 7:
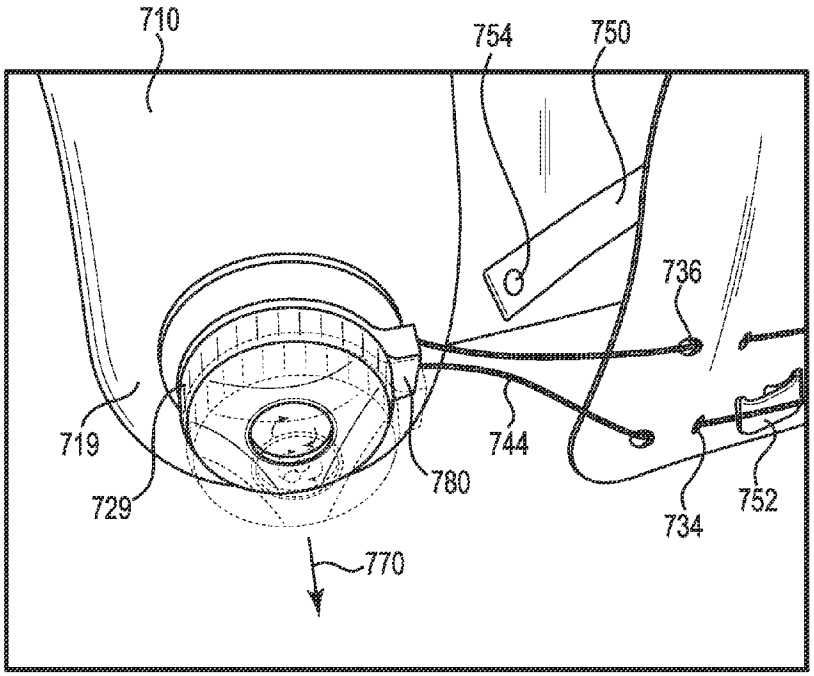
FIG. 7 illustrates an example detail of a second side of an example of a protective cover for an article of footwear including a reel, rotatable knob, and cable portion of a connecting mechanism according to the present disclosure.

FIG. 7 illustrates an example detail of a second side of an example of a protective cover for an article of footwear including a reel, rotatable knob, and cable portion of a connecting mechanism according to the present disclosure. In the example of FIG. 7, the rotatable knob 729 can be mounted on a second side of the second portion 710. The rotatable knob 729 can be disengaged from the reel 780 housed therein by causing the rotatable knob 729 to move away and outward from the second portion 710 as indicated by the line 770. Disengaging the rotatable knob 729 from the reel 780 can unpin the reel 780 such that the reel 780 can unwind freely and can allow for the tension in the cable 744 to slacken. This can allow the first portion (e.g., first portion 604 illustrated in FIG. 6) and the second portion 710 of the cover (e.g., cover 600 illustrated in FIG. 6) to be separated to a full enough extent that the flange (e.g., flange 522 illustrated in FIG. 5) can be disconnected from the flange connector (e.g., 524 illustrated in FIG. 5), as described in more detail in connection with FIG. 8.

Figure 8:
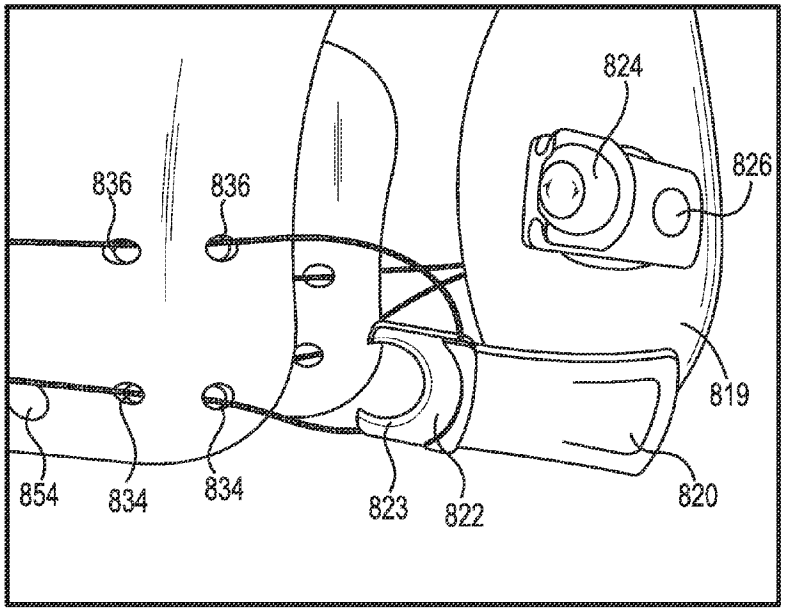
FIG. 8 illustrates an example detail of a first side of an example of a protective cover for an article of footwear including a flange and tab portion of a connecting mechanism according to the present disclosure.

FIG. 8 illustrates an example detail of a first side of an example of a protective cover for an article of footwear including the flange and tab portion of a connecting mechanism according to the present disclosure. In the example of FIG. 8, flange 822 can be disengaged from flange connector 824 to facilitate removal or installation of the cover (e.g., cover 100 illustrated in FIG. 1) from the footwear. Flange connector 824 can be affixed to the second portion 810 by a flange connector mounting system 826. In some examples, flange connector mounting system 826 can be a rivet. However, examples are not so limited and flange connector mounting system 826 can be connected to the second portion 810 by any suitable fastener. For example, the flange connector mounting system 826 can be connected to the second portion 810 by a captive fastener, snap fastener, adhesive, etc.

In some embodiments, as shown in the example of FIG. 8, the flange 822 can be provided with a grooved edge 823 that can seat inside a portion of flange connector 824 to facilitate a connection between flange 822 and flange connector 824. In some examples, grooved edge 823 can be manufactured from a durable but pliant material, for example, rubber, polychloroprene polytetrafluoroethylene, etc. However, it will be appreciated by one skilled in the art that grooved edge 823 can be manufactured from other pliant materials and/or a rigid material such as aluminum, steel, etc.

Figure 9:
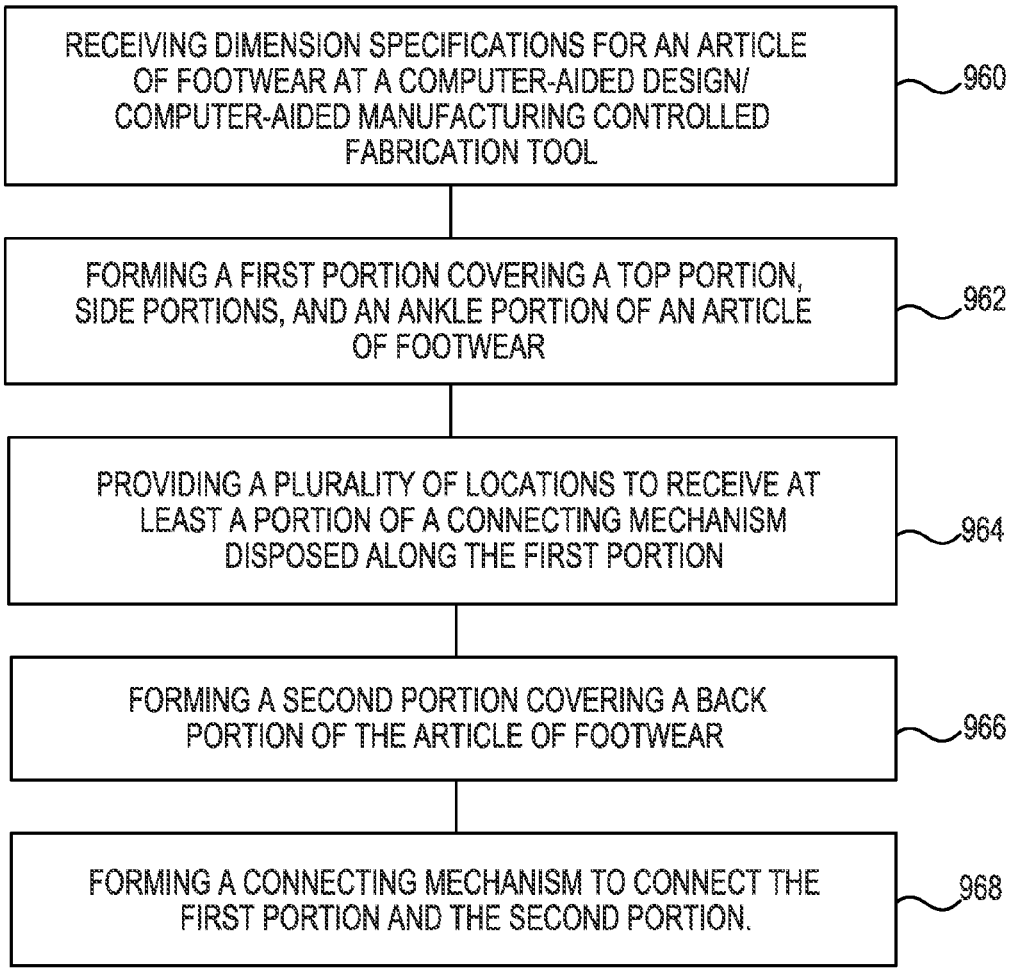
FIG. 9 illustrates a flow diagram of an example method for forming a protective cover for an article of footwear according to the present disclosure.

FIG. 9 illustrates a flow diagram of an example method for forming a protective cover for an article of footwear according to the present disclosure. In various examples, the method can be performed to manufacture the protective cover of FIGS. 1-8. Embodiments are not, however, so limited to these examples.

The method can include receiving dimension specifications for an article of footwear at a computer-aided design/computer-aided manufacturing (CAD/CAM) controlled fabrication tool, as shown at 960. In some examples, the dimension specifications for the article of footwear can be based on the brand, model, size, and/or other identifying features of the article of footwear. In this regard, a protective cover that is designed to fit a specific article of footwear can be formed. In some examples, the dimension specifications can be received as part of a just in time production strategy.

The method can include forming a first portion (e.g., first portion 104 illustrated in FIG. 1) covering a top portion, side portions, and an ankle portion of an article of footwear, as shown at 962. For example, first portion 104 illustrated in FIG. 1 can be formed. In some examples, the first portion (e.g., first portion 104 illustrated in FIG. 1) can be formed using additive manufacturing and/or 3D printing.

As shown at 964, the method can include providing a plurality of locations to receive at least a portion of a connecting mechanism along the first portion (e.g., first portion 104 illustrated in FIG. 1). For example, a plurality of apertures (e.g., 132-1, 132-2, . . . 132-N, 134-1, 134-2, . . . , 134-N, 136-1, 136-2, . . . , 136-N illustrated in FIG. 1) can be provided to the first portion (e.g., first portion 104 illustrated in FIG. 1) to receive at least a portion of a connecting mechanism.

At 966, the method can include forming a second portion (e.g., second portion 110 illustrated in FIG. 1) covering a back portion of the article of footwear. In some examples, the second portion can be the second portion 110 illustrated in FIG. 1. In some examples, the second portion (e.g., second portion 110 illustrated in FIG. 1) can be formed using additive manufacturing and/or 3D printing.

As shown at 968, the method can include forming a connecting mechanism to connect the first portion (e.g., first portion 104 illustrated in FIG. 1) and the second portion (e.g., second portion 110 illustrated in FIG. 1). In some examples, forming the connecting mechanism can include forming a cable (e.g., cable 140 illustrated in FIG. 1) attached at a first end to a connector (e.g., flange 122 illustrated in FIG. 1) and attached at a second end to a reel (e.g., reel 280 illustrated in FIG. 2), where the cable (e.g., cable 140 illustrated in FIG. 1) is received by the plurality of locations (e.g., 132-1, 132-2, . . . 132-N, 134-1, 134-2, . . . , 134-N, 136-1, 136-2, . . . , 136-N illustrated in FIG. 1) to receive the cable (e.g., cable 140 illustrated in FIG. 1), and where the connector (e.g., flange 122 illustrated in FIG. 1) is disposed on a first side of the second portion (e.g., second portion 110 illustrated in FIG. 1) and the reel (e.g., reel 280 illustrated in FIG. 2) is disposed on a second side of the second portion (e.g., second portion 110 illustrated in FIG. 1).

Figure 10:
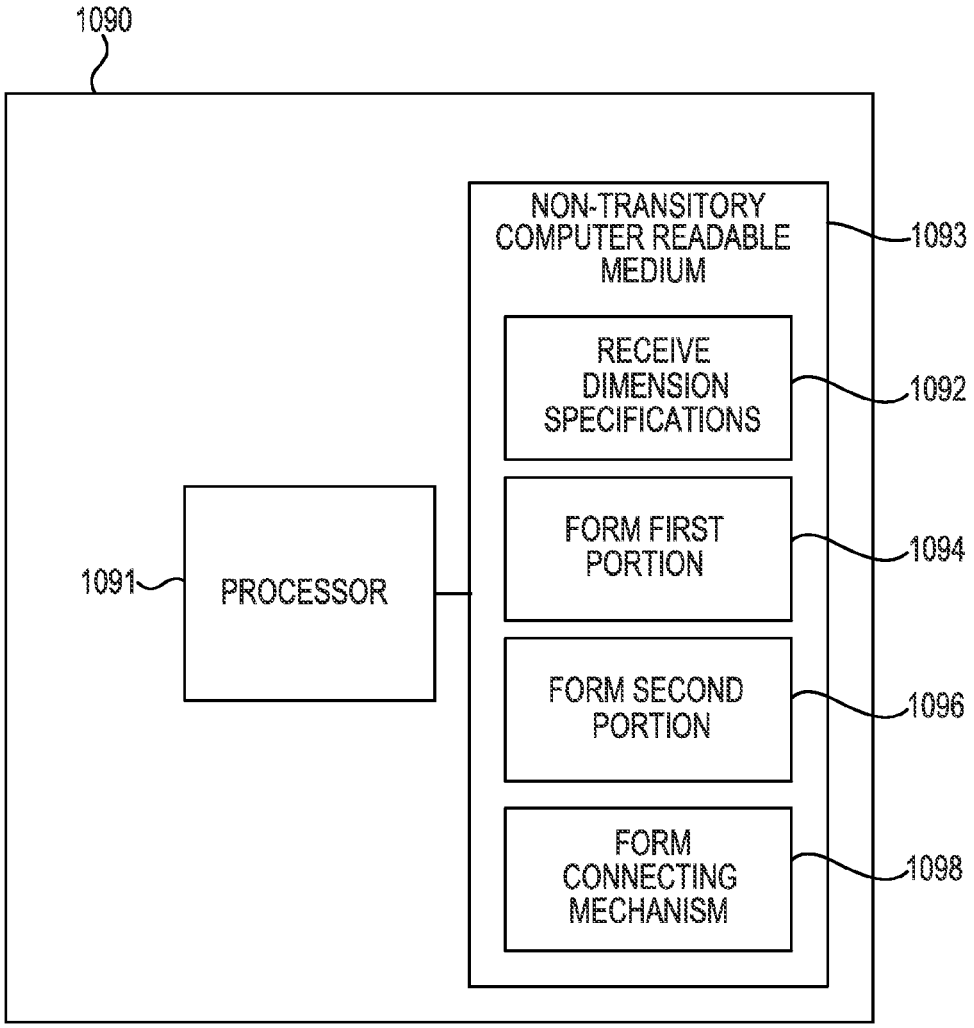
FIG. 10 illustrates an example system including a processor and non-transitory computer readable medium according to the present disclosure.

FIG. 10 illustrates an example system 1090 including a processor 1091 and non-transitory computer readable medium 1093 according to the present disclosure. The processor 1091 can be configured to execute instructions stored on the non-transitory medium 1093. For example, the non-transitory computer readable medium 1093 can be any type of volatile or non-volatile memory or storage, such as random access memory (RAM), flash memory, or a hard disk. When executed, the instructions can cause the processor 1091 to perform a method for forming a protective cover for an article of footwear, such as the method described with respect to FIG. 9.

The example medium 1093 can store instructions executable by the processor 1091 to form a protective cover for an article of footwear. For example, the processor 1091 can execute instructions 1092 to receive dimension specifications for an article of footwear at a computer-aided design/computer-aided manufacturing (CAD/CAM) controlled fabrication tool. For example, manufacturer specifications regarding a particular model of footwear can be received at a CAD/CAM controlled fabrication tool so the cover can be formed to fit the model of footwear it can be used with. In some examples, the instructions can be executable to form the protective cover using additive manufacturing and/or 3D printing. For example, the instructions can be executable to form the protective cover using stereolithography, fused deposition molding, selective laser sintering, or other computer aided additive and/or 3d printing methods.

The example medium 1093 can further store instructions 1094. The instructions 1094 can be executable to form the first portion of the cover. In some examples, the formed first portion is the same as first portion 104 illustrated in FIG. 1. In some examples, the method can include forming a plurality of extrusions (e.g., 460-1, 460-2, . . . , 460-N illustrated in FIG. 4) along the first portion (e.g., first portion 104 illustrated in FIG. 1). A strap (e.g., suspension mechanism 450 illustrated in FIG. 4) having a connection to a first side of the first portion (e.g., second portion 110 illustrated in FIG. 1) and a connection to the second side of the first portion (e.g., second portion 110 illustrated in FIG. 1) can be formed. In some examples, the strap can be adjustable on a side of the first portion (e.g., second portion 110 illustrated in FIG. 1).

The example medium 1093 can further store instructions 1096. The instructions 1096 can be executable to form the second portion of the cover. For example, second portion 110 illustrated in FIG. 1.

The example medium 1093 can further store instructions 1098. The instructions 1098 can be executable to form a connecting mechanism to connect the first portion (e.g., first portion 104 illustrated in FIG. 1) and the second portion (e.g., second portion 110 illustrated in FIG. 1). In some examples, forming the connecting mechanism can include forming a cable (e.g., cable 140 illustrated in FIG. 1) attached at a first end to a connector and attached at a second end to a reel (e.g., reel 280 illustrated in FIG. 2), where the cable (e.g., cable 140 illustrated in FIG. 1) is received by a plurality of locations to receive the cable, and where the connector is disposed on a first side of the second portion (e.g., second portion 110 illustrated in FIG. 1), and the reel is disposed on a second side of the second portion (e.g., second portion 110 illustrated in FIG. 1).

The figures herein follow a numbering convention in which the first digit corresponds to the drawing figure number and the remaining digits identify an element or component in the drawing. For example, reference numeral 102 may refer to element "02" in FIG. 1 and an analogous element may be identified by reference numeral 202 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of" an element and/or feature can refer to one or more of such elements and/or features.

What is claimed:

1. A protective cover for an article of footwear, comprising:

a first portion comprising a one-piece shell having an upper surface, and two opposing side surfaces covering a top, a first side ankle portion, and a second side ankle portion of the footwear, wherein the first portion is provided with a plurality of locations to receive at least a portion of a connecting mechanism; and a second portion comprising a one-piece shell covering the back of the footwear, wherein the connecting mechanism connects the first portion at the first side ankle portion to the second portion, and connects the first portion at the second side ankle portion to the second portion; and wherein the connecting mechanism remains connected to the first portion and the second portion only at the first side ankle portion when the connecting mechanism is completely disconnected at the second ankle side portion of the cover to facilitate ease of placement and removal of the protective cover around the article of footwear.

2. The protective cover of claim 1, wherein the first portion and the second portion are formed from high impact carbon.

3. The protective cover of claim 1, wherein the first portion includes a cupping portion to cup at least a bottom side portion and bottom toe portion of the footwear; and wherein the second portion includes a cupping portion to cup a bottom heel portion of the footwear.

4. The protective cover of claim 3, wherein the cupping portion of the first portion is permanently connected to the footwear.

5. The protective cover of claim 1, wherein the connecting mechanism comprises:

a flange disposed on a first side of the second portion;

a rotatable knob disposed on a second side of the second portion; and a cable having a first end connected to a part of a tab and a second end disposed inside a reel connected to the rotatable knob.

6. The protective cover of claim 1, wherein the plurality of locations to receive at least a portion of the connecting mechanism are apertures.

7. The protective cover of claim 6, wherein the apertures are disposed along a plurality of raised extrusions on the first portion.

8. The protective cover of claim 1, further comprising a suspension mechanism comprising an adjustable strap connecting from one side of the two opposing side surfaces to the other side of the two opposing side surfaces to provide spacing between at least the first portion of the cover and the article of footwear.

9. The protective cover of claim 8, wherein the adjustable strap is fixed to one side of the two opposing side surfaces and is adjustable by tensioning on an opposite side of the two opposing side surfaces.

10. A protective cover for an article of footwear, comprising:

a first portion comprising a one-piece shell having:

a top portion covering an instep portion and a toe portion of the footwear configured to cup a bottom portion of the footwear;

the top portion connected to a sidewall portion having:

a side portion covering a side portion and an ankle portion of the footwear configured to cup a bottom side portion of the footwear;

the top portion having a plurality of locations to receive at least a portion of a connecting mechanism;

a second portion comprising a one-piece shell covering a back portion of the footwear configured to cup a back bottom portion of the footwear;

the connecting mechanism having:

a flange connector to provide connection to a flange; and a cable to:

connect to the flange at a first end of the cable;

connect to a tightening mechanism at a second end of the cable; and connect to the plurality of locations to receive the portion of the connecting mechanism, wherein only the second end of the cable remains coupled to the first portion and the second portion when the first end of the cable is completely disconnected form the flange connector, to facilitate placement and removal of the cover around the article of footwear.

11. The protective cover of claim 10, further comprising a suspension mechanism comprising a strap, wherein a first end of the strap is connected to a first interior side of the sidewall portion, and a second end of the strap is connected to a second interior side of the sidewall portion, the adjustment mechanism to provide a space between the first portion of the cover and the footwear.

12. The protective cover of claim 11, wherein the strap is tensionable to alter the length of the strap.

13. The protective cover of claim 10, wherein the plurality of locations to receive at least a portion of a connecting mechanism comprise a plurality of apertures disposed along the sidewall portions and top portion of the first portion.

14. The protective cover of claim 10, wherein the top portion is configured to cup a bottom toe portion of the footwear.

15. A protective cover for an article of footwear, comprising:

a first portion covering an instep and toe portion of the footwear and configured to cup a front bottom portion of the footwear, wherein the first portion includes a plurality of locations to receive at least a portion of a connecting mechanism; and a second portion covering a back portion of the footwear and configured to cup a back bottom portion of the footwear, wherein the connecting mechanism coupled to the first portion and the second portion, the connecting mechanism to remain coupled to the first portion and the second portion only on a first side of the first portion and second portion when the connecting mechanism is completely decoupled at a second side of the first portion and second portion such that the cover is easily placeable and removable around the article of footwear.

16. The protective cover of claim 15, wherein the connecting mechanism includes a strap.

17. The protective cover of claim 15, wherein the first portion and the second portion are made of a same material.

18. The protective cover of claim 15, wherein the first portion and the second portion are made of different materials.

19. The protective cover of claim 15, wherein a thickness of the first portion varies throughout the first portion.

20. The protective cover of claim 15, wherein a thickness of the second portion varies throughout the second portion.

* * * * *